United States Patent [19]

Weber et al.

[11] 4,080,894

[45] Mar. 28, 1978

[54] ROTARY PRINTING MACHINES

[75] Inventors: Roger Weber, Pfastatt; André Lotte, Mulhouse, both of France

[73] Assignee: Societe Alsacience de Constructions Mechaniques de Mulhouse, Mulhouse, France

[21] Appl. No.: 706,950

[22] Filed: Jul. 20, 1976

[30] Foreign Application Priority Data

Aug. 12, 1975 France ..... 75 25046

[51] Int. Cl.[2] ..... B41F 15/38

[52] U.S. Cl. ..... 101/128.1

[58] Field of Search ..... 101/127.1, 128.1, 116–120, 101/378, 415.1, 375, 376, 127; 29/129.5

[56] References Cited

U.S. PATENT DOCUMENTS

| | | | |
|---|---|---|---|
| 954,090 | 4/1910 | Goss | 101/378 |
| 1,275,643 | 8/1918 | Bechman | 101/378 |
| 2,104,854 | 1/1938 | Dean et al. | 101/378 |
| 3,556,004 | 1/1971 | Mitter | 101/127.1 X |
| 3,599,565 | 8/1971 | Feier | 101/127.1 X |

*Primary Examiner*—J. Reed Fisher

*Attorney, Agent, or Firm*—Holman & Stern

[57] ABSTRACT

A locking and centering apparatus for fastening the ferrule to the casing in a rotary printing machine, the present invention comprises a plurality of resilient catch members mounted on a first locking ring, the locking ring being carried on the casing. The catch members engage end portions of the ferrule and are biased into engagement therewith by a second locking ring carried on said first locking ring.

15 Claims, 5 Drawing Figures

X
X'
2
4
6
6'
8
10
12
14
16
18
20
22
24
26
28
32
34
36
38
44
46
48
50
52
54
56
58
62
64
68

ROTARY PRINTING MACHINES

BACKGROUND OF THE INVENTION

This invention relates to attachment means enabling the introduction and withdrawal of a screen to and from printing heads by a simple vertical translation of the screen without having to move the printing heads back.

Locking rings sliding with the casings of printing heads come into cooperation with locking means carried by the ferrules of the screens. The locking rings have associated therewith catches each having an axially resilient part taking up deficiencies in the trueing of the screen.

The invention is applicable to multi-colour printing machines especially for the printing of textiles.

The invention also relates to machines for printing strip materials, especially cloths, comprising rotary cylindrical screens.

It is known that these screens are mounted, at each of their ends, on a rigid band known as a "ferrule" and that, each time a screen is changed, these ferrules must be dismounted from and then remounted on the printing head of the machine, and more precisely, on the casing of the printing head which ensures the tensioning and the synchronous driving of the screen in question with all of the other screens of the machine.

Up to the present, the mounting of the screen ferrule on the casing of the printing head has generally been effected by a bayonet joint or by similar integrating devices necessitating a relative engagement of the ferrule casing. With such devices, it has been necessary, in order to remove a screen from the printing head, to withdraw the printing head in the outwards direction from the machine in order to release the screen ferrule from the inside (or the outside) of the casing. This operation has made the setting up of the screens relatively time-consuming and has then necessitated an adjustment of the position of the printing heads.

The present invention enables the making of a rapid holder device owing to which the screens of a printing machine may be set up and removed without it being necessary to displace the printing heads.

SUMMARY OF THE INVENTION

The subject of the invention is a holder device in which the screen ferrule is held, facing the end surface of the casing of the printing head, but without being engaged inside the casing, by at least one locking ring supporting first locking and centering means cooperating with corresponding second means on the ferrule. The locking ring is mounted to be axially slidable on the end of said casing between a locking moved-out position in which said first and second means cooperate, and a retracted position, in which said first and second means are disengaged and in which said ring is withdrawn with respect to said end surface of the casing.

In accordance with a preferred embodiment of the invention, the locking means supported by the ring are resilient means, at least in the axial direction of the casing and of the ferrule, owing to which the latter is resiliently held on the casing, which results in trueing deficiencies of the screen on the ferrule being automatically taken up.

The invention will be better understood on reading the following detailed description and with the help of the drawings, which show, by way of non-limiting example, one of the embodiments of the invention.

DESCRIPTION OF THE PREFERRED EMBODIMENT

Figure 1:
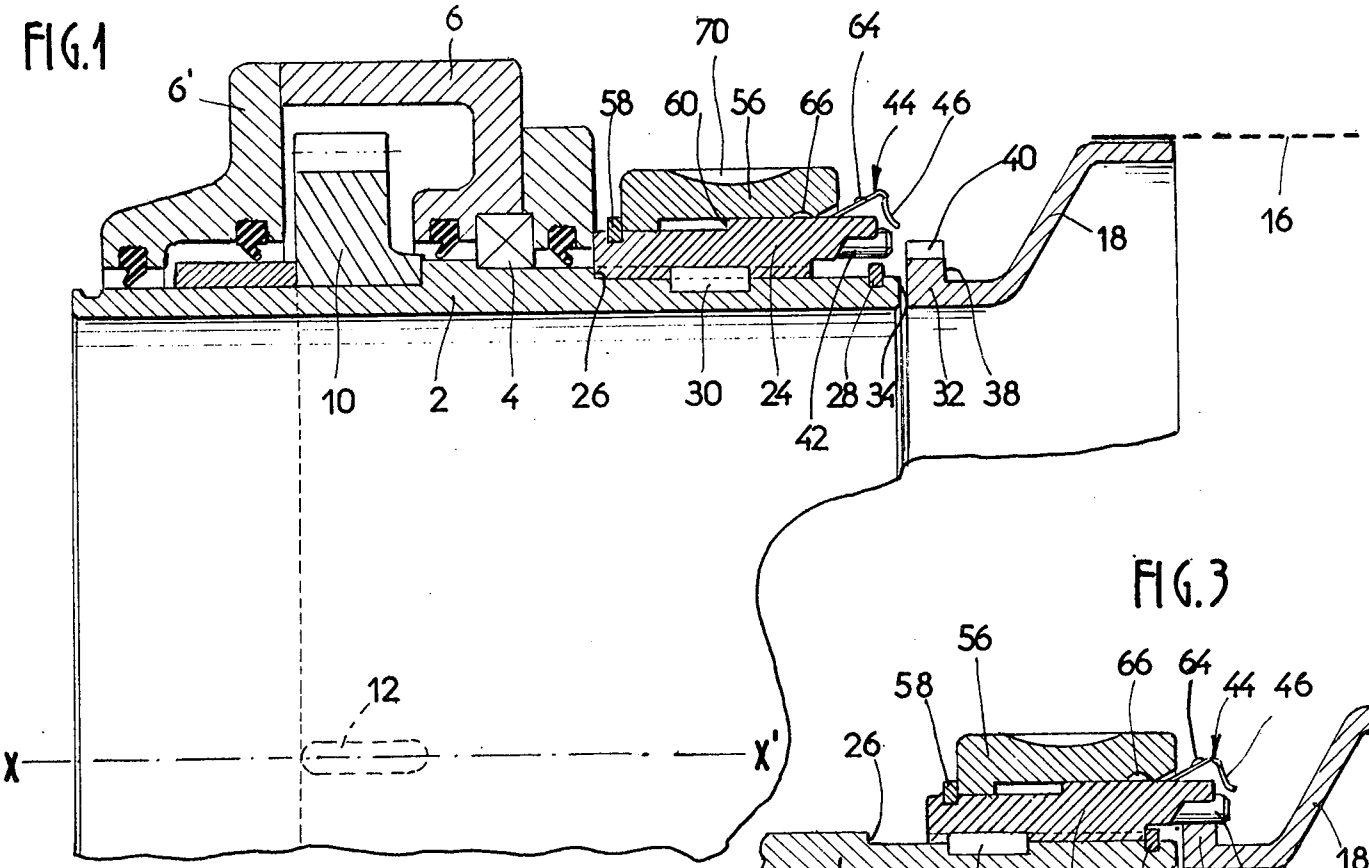
FIG. 1 is a sectional view showing the upper parts of the printing head and of the screen ferrule, the locking ring being shown in the disengaged position.
Figures 2, 4, 5:
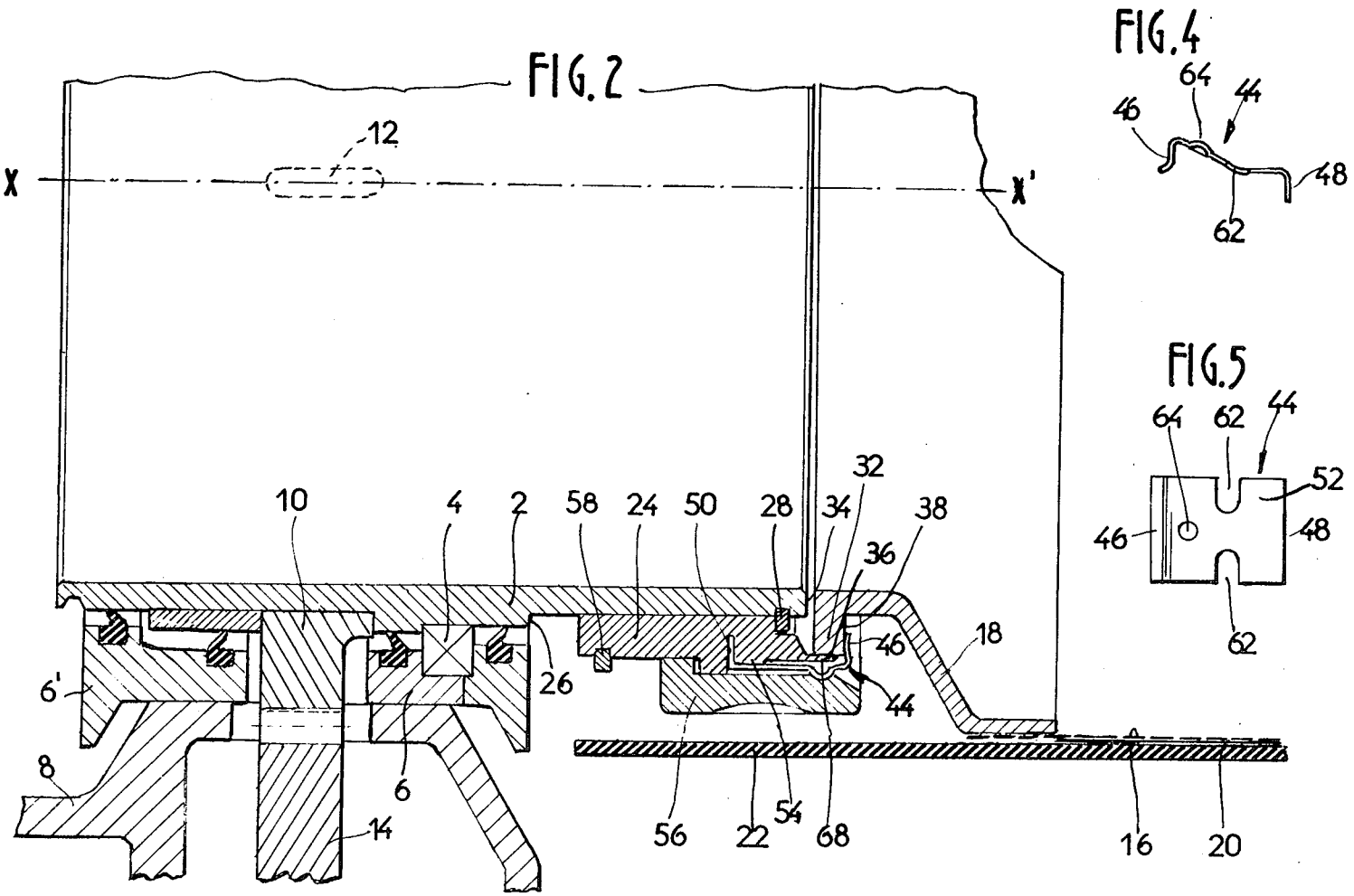
FIG. 2 is a sectional view showing the lower parts of the printing head and of the screen ferrule, the locking ring being shown in the locked position.
FIG. 4. and 5 are elevational and plan views of the locking catches.

The printing head shown in FIGS. 1 and 2 comprises a casing 2 which is journalled in a bearing 4 mounted in bearing caps 6 — 6' supported by the frame 8 of the printing machine.

The casing 2 is rotatably driven about its axis X — X' by a toothed rim 10 which is keyed at 12 on the casing and which meshes with a pinion 14 journalled in the frame 8 of the machine.

A cylindrical rotary screen 16 is adhered at each of its ends on a ring or ferrule 18. The screen prints strip material such as cloth 20 which is drawn below the screen by a belt 22. Of course, a substanially identical printing head is arranged at the other side of the machine in order to support and carry along the other end of the screen.

The object of the holding system in accordance with the invention is to fixedly connect the screen ferrule 18 on the casing of the printing head, axially and for rotation, the locking in the axial sense being preferably semi-elastic, The system comprises a first locking ring 24 which is mounted for axial sliding movement on the end of the casing 2. This ring may slide from a retracted or disengaged position (FIG. 1.) to a moved-out or locking position (FIG. 2.) The displacements on sliding of the ring are limited on the one hand by a shoulder 26 cut in the casing 2, and on the other hand by a stop such as a ring 28. The ring 24 is locked for rotation with the casing, for example by means of a key 30.

The ring 24 supports locking and centering means which cooperate with corresponding members of the ferrule 18.

The centering and locking means provided on the ferrule 18 are constituted by a radial lip or flange 32 which, when the ferrule is in place in the printing head, is opposite the end face 34 of the casing, As will be apparent as this description proceeds, the external cylindrical surface of the flange 32 constitutes the centering means, the annular radial surface 38 of the same flange constitutes the axial locking means, while at least one hollowed part such as a notch 40 cut in the rim of the flange 32, constitutes the means for locking the ferrule relative to the casing for rotation therewith.

Figure 3:
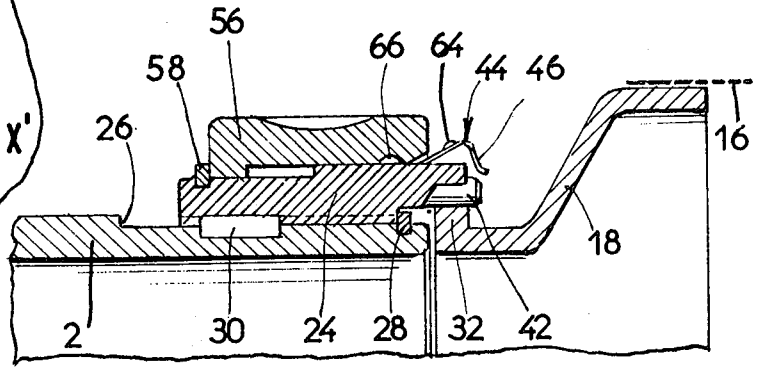
FIG. 3 is a fragmentary sectional view showing the ring in an intermediate position, after centering of the ferrule, but before locking thereof.

The ring 24 includes first locking means interlocking the ferrule on the casing for rotation therewith, this locking means being constituted by a projecting part or a plurality of projecting parts, such as a pin 42 adapted to be engaged in the notch 40 in the moved-out position of the ring (see FIG. 3).

The ring 24 also includes second locking means intended fixedly to interconnect the ferrule and the casing in the axial sense. These second locking means are constituted by movable hooks or catches 44, numbering for example three or four, distributed enquiangularly at the periphery of the ring.

These catches may be of any type whatsoever, seeing that they are hinged on the ring 24 and that their noses 46 may be pressed down and kept behind the surface 38 of the flange 32 of the ferrule.

One preferred embodiment of these catches is shown in FIGS. 4 and 5. Each catch is cut and bent in a thin sheet of resilient metal to which is given the profile indicated in FIG. 4. The pressed down edge 48 of the catch is engaged in a slit 50 in the ring 24, while the body 52 is located flush within a hollowed-out seating 54 (FIG. 2), with the result that each catch is fixed in position on the ring 24, the catches when at rest occupying the raised position indicated in FIGS. 1 and 3.

In order to press down and lock all of the catches on the flange 32 at the same time, use is preferably made of a second ring 56 which slides over the first ring 24 between the stops 58 and 60, the second ring not being rotatively immobilised relative to the first. When the second ring is caused to slide towards the ferrule 18, from the position in FIG. 3 to the position in FIG. 2, all of the catches are brought down by the second ring to come to embrace the flange 32 of the ferrule and are retained by this ring in opposition to their resilience which tends to make them resume their opened position (FIGS. 1 and 4).

The resilient return force of the catches may be set by selecting the depth of the notches 62 provided in the body 52 of the catches.

Preferably, the nose 46 is bent back beyond a right angle, as is shown in the drawings, so that the catches, once pressed into the locked position, offer some axial resilience permitting a slight difference in parallelism, in the locked position, of the end plane surfaces of the casing and of the ferrule. This arrangement offers a considerable advantage, as will hereinafter be specified.

The retention of the catches in the locked position by the ring 68 may be complemented by a semi-resilient locking arrangement which comprises, on the catches, projecting bosses 64 which engage in a groove 66 hollowed out at the inside of the ring 56.

Finally, the first ring 24 may include centering means constituted by an end rim 68 which comes into covering relationship with the external cylindrical surface 36 of the flange 32 of the ferrule.

It follows from the foregoing that the screen 16 may be set up and removed without having to move the printing head.

It can indeed be seen in FIG. 1, that, in the unlocked condition, all of the holding members (ring, catches, etc.) are set back from the end face 34 of the casing 2, with the result that the screen 16 with its ferrules 18 may be freely removed (or set up) by a simple vertical movement.

For the setting up, it is sufficient to centre the ferrule of the screen on the casing, with the notch 40 opposite the pin 42 (FIG. 1). The rings 24 and 56 are then moved together by hand towards the ferrule until they arrive at the intermediate position of FIG. 3. It should be noted that, during the course of this movement, the ring 56 is not displaced relative to the ring 24 as the resilience of the catches 44 fixes the ring 56 in position.

In this intermediate position of FIG. 3, the pin 42 enters into the notch 40 and the rim 58 of the ring 24 comes into covering relationship with the flange 32 of the ferrule. In this first stage, the casing and the ferrule are thus centered and made rotatively fast with one another.

If the action on the ring 56 is continued by pushing same towards the ferrule, the ring 24, which has reached the end of its movement, moves no further and the ring 56, on sliding relative to the ring 24, presses the catches 44 in the direction of the axis XX' as is shown in FIG. 2. The ring 56 remains jammed semi-resiliently in this position by the bosses 64 entering the groove 66 in the ring 24. From this moment on, the ferrule of the screen is fast with the casing in the axial direction.

It should however, be noted that this integration is effected under the resilient constraint of the noses 46 of the catches 44, this offering the considerable advantage that any deficiencies in the trueing of the screen 16 in relation to the ferrule 18 are automatically compensated.

The unlocking is effected by sliding the rings in the opposite direction, the operator having in this case to act only upon the second ring 56 in which there may be provided a recess 70 or grooving to facilitate the grip.

It is thus clearly apparent that the device in accordance with the invention, particularly owing to the fact that there is no jointing between the ferrule and the casing, is much faster than the known bayonet devices. Moreover, it presents the advantage of being able to accept without inconvenience screens which have trueing deficiences. Of course, the invention is not restricted to the embodiment described and shown, and is capable of numerous variations, open to the expert, in accordance with the applications in prospect and without thereby departing from the scope of the invention.

We claim:

1. In a rotary printing machine, apparatus for mounting a ferrule of a rotary cylindrical screen on the casing of a printing head wherein the ferrule is held facing the end surface of said casing without being engaged within the casing, the improvement comprising:

means for locking and centering the ferrule to the casing;

means carried on the ferrule for receiving portions of said locking and centering means;

an annular locking ring which carries the locking and centering means and which is carried for sliding axial movement on the inner end of the casing, the locking ring being slidable on the body of the casing between a first position in which the locking and centering means and the receiving means are engaged to lock and center the ferrule to the casing and a second position in which the locking and centering means and the receiving means are disengaged to free the ferrule from the casing, and means for mounting the locking ring on the casing to cause said ring to be rotatable with said casing.

2. The apparatus of claim 1 wherein the locking and centering means comprise:

a first locking member for engaging the ferrule to cause said ferrule to rotate with said casing; and, second locking members for engaging the ferrule to cause said ferrule to be centered axially with respect to said casing.

3. The apparatus of claim 2 wherein the first locking member comprises at least one projecting element carried on the ring and wherein the receiving means comprise an annular flange formed at the end of the ferrule, the flange having a recess formed therein, the projecting element being received within the recess to lock said casing to said ferrule.

4. The apparatus of claim 3 wherein the locking and centering means comprise outer cylindrical surfaces of said flange of said ferrule and rim means carried on the ring, the rim means surmounting the outer cylindrical surfaces of said flange when the apparatus is in the locked position.

5. The apparatus of claim 3 wherein the second locking members comprise a plurality of catches mounted about the periphery of the ring, the catches radially engaging portions of the flange on the ferrule to center the ferrule with respect to the casing.

6. The apparatus of claim 5 wherein the catches are axially resilient, the ferrule being resiliently retained in facing relation to end portions of the casing about the periphery of the casing.

7. The apparatus of claim 6 and further comprising a second locking ring slidingly mounted on said first-mentioned locking ring, said second locking ring being capable of occupying with respect to said first-mentioned ring a locking position in which it cooperates with said catches to press them over said flange and a disengaged position in which it releases said catches.

8. The apparatus of claim 7 wherein the catches comprise thin resilient plates bent to catch form and fixed to said first-mentioned ring, said thin resilient plates spreading out at rest to be moved away from said first-mentioned ring and to release said flange of said ferrule, and in which said second ring, in the locking position, keeps said catches pressed down against the resilient force which tends to move them away from said first-mentioned ring.

9. The apparatus of claim 8 wherein the catches have projecting portions and wherein the second ring has recessed portions which receive the projecting portions of the catches therein to lock said catches and second ring in the locked position.

10. In a rotary printing machine, apparatus for mounting a ferrule of a rotary cylindrical screen on the casing of a printing head wherein the ferrule is held facing the end surface of said casing without being engaged within the casing, the improvement comprising:

a first locking ring carried on the end of the casing for rotation therewith and for axial sliding movement thereon between positions wherein the ferrule is locked and unlocked with respect to the casing;

at least one projecting element carried on the first ring, the ferrule having a flange formed thereon, the flange having at least one recess formed therein, the projecting element being received within the recess to lock the ferrule to the casing;

a plurality of catches mounted about the periphery of the first ring, the catches radially engaging portions of the flange to center the ferrule with respect to the casing; and a second locking ring slidably carried on the first locking ring, the second locking ring being movable between positions wherein the catches are biased over the flange and wherein the catches are released from the flange.

11. The apparatus of claim 10 wherein the catches are axially resilient, the ferrule being resiliently retained in facing relation to the end portions of the casing about the periphery of the casing.

12. The apparatus of claim 10 wherein the catches are equiangularly spaced about the periphery of the first locking ring.

13. The apparatus of claim 10 wherein the catches comprise thin resilient plates bent to catch form, the plates spreading out at rest to be moved away from the first ring and to release the flange of the ferrule, the second ring pressing the catches down on the flange against the resilient force of said catches in the locked position.

14. The apparatus of claim 13 wherein the catches have projecting portions and wherein the second ring has recessed portions which receive the projecting portions of the catches therein to lock said catches and second ring in the locked position.

15. The apparatus of claim 10 and further comprising rim means formed on the first ring for extending into surmounting and covering contact with outer cylindrical surfaces of the flange when in the locked position, the rim means and flange acting to center the ferrule with respect to the casing.

* * * * *